US008822823B2

(12) United States Patent
Ahn

(10) Patent No.: US 8,822,823 B2
(45) Date of Patent: Sep. 2, 2014

(54) DOUBLE WATER-TIGHT STRUCTURE PROTECTING DEVICE FOR ELECTRIC CHARGING PART OF POLE

(76) Inventor: Sung Bum Ahn, Masan-si (KR)

( * ) Notice: Subject to any disclaimer, the term of this patent is extended or adjusted under 35 U.S.C. 154(b) by 268 days.

(21) Appl. No.: 13/056,659

(22) PCT Filed: Sep. 1, 2008

(86) PCT No.: PCT/KR2008/005111
§ 371 (c)(1),
(2), (4) Date: Jan. 29, 2011

(87) PCT Pub. No.: WO2010/024487
PCT Pub. Date: Mar. 4, 2010

(65) Prior Publication Data

US 2011/0132636 A1 Jun. 9, 2011

(30) Foreign Application Priority Data

Aug. 29, 2008 (KR) ..... 10-2008-0084952

(51) Int. Cl.
*H01B 3/00* (2006.01)
*F21V 31/00* (2006.01)

(52) U.S. Cl.
USPC ..... 174/110 R; 174/5 SB

(58) Field of Classification Search
USPC ..... 174/85, 93, 22 R, 23 R, 5 R, 5 SB, 50.5, 174/74 A, 80, 110 R, 137 R, 138 R, 154, 155, 174/156, 158 R; 362/158; 52/302.5
See application file for complete search history.

(56) References Cited

U.S. PATENT DOCUMENTS

| | | | | |
|---|---|---|---|---|
| 5,266,742 | A * | 11/1993 | Heier et al. | 174/93 |
| 5,753,861 | A * | 5/1998 | Hansen et al. | 174/93 |
| 5,865,427 | A * | 2/1999 | Cowan | 256/19 |
| 6,284,976 | B1 * | 9/2001 | Pulido et al. | 174/77 R |
| 7,014,513 | B2 * | 3/2006 | Tomasino | 439/784 |
| 7,767,909 | B2 * | 8/2010 | Krabs et al. | 174/84 R |

(Continued)

FOREIGN PATENT DOCUMENTS

| | | |
|---|---|---|
| KR | 10-2004-0085222 | 10/2004 |
| KR | 10-2007-0044411 | 4/2007 |

(Continued)

OTHER PUBLICATIONS

International Search Report for PCT/KR2008/005111 mailed on May 22, 2009.

*Primary Examiner* — Jenny L Wagner
*Assistant Examiner* — Dimary Lopez
(74) *Attorney, Agent, or Firm* — Revolution IP, PLLC

(57) ABSTRACT

Disclosed therein is a double water-tight structure protecting device for an electric charging part of an electric facility. The double water-tight structure protecting device includes: an insulator (300) attached on the outer peripheral surface of the electric charging part of the electric facility; a first tube-shaped protective cover (100) located at an upper portion of the insulator (300) in such a way as to surround an outer face of the insulator (300); a first waterproof member (110) interposed between the insulator (300) and the first protective cover (100); and a second waterproof member (120) interposed between the insulator (300) and the first protective cover (100) and located between a lower end portion of the first waterproof member (110) and a lower end portion of the first protective cover (100).

18 Claims, 3 Drawing Sheets

(56) References Cited

U.S. PATENT DOCUMENTS

| | | | | |
|---|---|---|---|---|
| 2006/0037687 | A1* | 2/2006 | Buekers et al. | 156/53 |
| 2007/0209821 | A1* | 9/2007 | Otsuki et al. | 174/88 R |
| 2008/0000684 | A1* | 1/2008 | Dower et al. | 174/74 A |

FOREIGN PATENT DOCUMENTS

| | | |
|---|---|---|
| KR | 10-0708008 | 4/2007 |
| KR | 10-0712318 | 4/2007 |
| KR | 10-0783041 | 12/2007 |

* cited by examiner

DOUBLE WATER-TIGHT STRUCTURE PROTECTING DEVICE FOR ELECTRIC CHARGING PART OF POLE

RELATED APPLICATIONS

This application is a 371 application of International Application No. PCT/KR2008/005111, filed Sep. 1, 2008, which in turn claims priority from Korean Patent Application No. 10-2008-0084952, filed Aug. 29, 2008, each of which is incorporated herein by reference in its entirety.

TECHNICAL FIELD

The present invention relates to a double water-tight structure protecting device for an electric charging part of an electric facility, and more particularly, to a double water-tight structure protecting device for an electric charging part of an electric facility, which includes: an insulator (300) attached on the outer peripheral surface of the electric charging part of the electric facility; a first tube-shaped or cap-shaped protective cover (100) located at an upper portion of the insulator (300) in such a way as to surround an outer face of the insulator (300); a first waterproof member (110) interposed between the insulator (300) and the first protective cover (100); and a second waterproof member (120) interposed between the insulator (300) and the first protective cover (100) and located between a lower end portion of the first waterproof member (110) and a lower end portion of the first protective cover (100).

BACKGROUND ART

In general, road facilities (traffic lights, road lights, CCTVs, iron props, and so on) using electric power are left alone as they are till troubles are checked even though their electric parts are exposed, or adopt safety devices, such as alarms. However, such methods may cause second troubles due to feature changes or troubles of the safety devices.

In order to solve such problem however just a little it may be, Korean Patent No. 10-0553061 discloses a device for warning electric shock hazard with an auxiliary function of a short-circuit prevention, and a partial water-proof structure has been disclosed. However, such prior arts have several problems in that the secondary trouble of the device causes many expenses and requires a predetermined time period till the problem is solved after a warning is checked, and in that another problem frequently occurs due to an exposure of an electric charging part during the time period to solve the problem.

Furthermore, it is impossible to solve problems caused by other factors (for instance, a damage of a track of an underground power line during excavation of a road, a damage of a track of an aerial power line by wind pressure, and water penetration due to another factor).

Moreover, in order to prevent adhesion of advertising posters on the outer peripheral surface of the prop, there are many methods, such as a simple synthetic resin coating, iron coating, pasting of a stone powder mixture, embossment of the prop, fitting of an embossed protection plate, and so on. However, such methods have a problem in that they need removal and maintenance, and a fatal problem in that the electric charging part having electric power is exposed to the surface of the prop along a track of rainwater since rainwater drops down along the prop to the surface of an insulator attached on the outer peripheral surface of the prop.

DISCLOSURE OF INVENTION

Technical Problem

Accordingly, in order to solve the above-mentioned problems occurring in the prior arts, the present invention provides a double water-tight structure protecting device for an electric charging part of an electric facility, which is based on the surface tension action of water and polymer insulation and has the following objects.

First, it is an object of the present invention to provide a double water-tight structure protecting device for an electric charging part of an electric facility, which can permanently provide an enhanced safety index of pedestrians, who walk on the road in the rainfall season when the electric charging part is frequently exposed to the outside.

Second, it is another object of the present invention to provide a double water-tight structure protecting device for an electric charging part of an electric facility, which can doubly form charging part protecting zones since protective covers are mounted on upper and lower portions of an outer face of an insulator in such a way as to be spaced apart from the insulator.

Third, it is a further object of the present invention to provide a double water-tight structure protecting device for an electric charging part of an electric facility, which includes an engraved portion formed on the outer peripheral surface of the environmentally-friendly insulator for carving signs, characters or figures thereon or attaching highly bright reflection paper thereto, thereby preventing adhesion of advertising posters, increasing insulation efficiency, and providing an advertising effect to thereby provide an environmentally-friendly efficiency, safety, and an image enhancement effect.

Fourth, it is a still further object of the present invention to provide a double water-tight structure protecting device for an electric charging part of an electric facility, which includes an RFID tag saving information of various kinds and embedded in the insulator, thereby contributing to establishment of the U-city as a foundation facility.

Technical Solution

To achieve the above objects, the present invention provides a double water-tight structure protecting device for an electric charging part of an electric facility including: an insulator (300) attached on the outer peripheral surface of the electric charging part of the electric facility; a first tube-shaped or cap-shaped protective cover (100) located at an upper portion of the insulator (300) in such a way as to surround an outer face of the insulator (300); a first waterproof member (110) interposed between the insulator (300) and the first protective cover (100); and a second waterproof member (120) interposed between the insulator (300) and the first protective cover (100) and located between a lower end portion of the first waterproof member (110) and a lower end portion of the first protective cover (100).

EXPLANATION OF ESSENTIAL REFERENCE NUMERALS IN DRAWINGS

Figure 1:
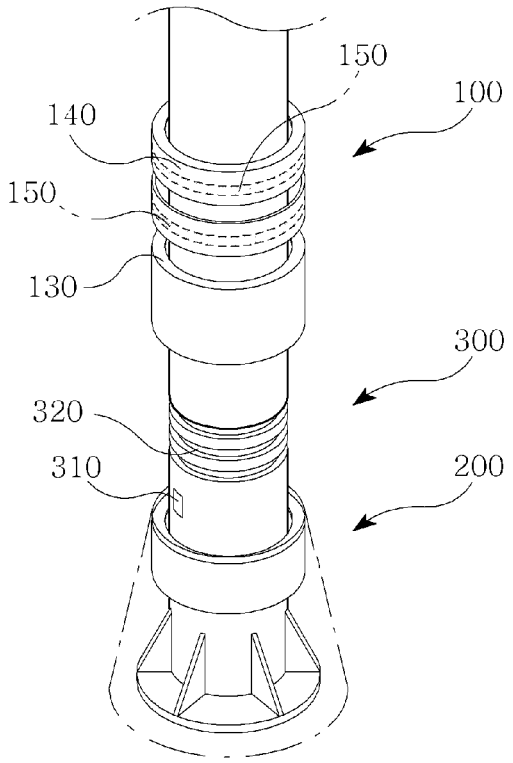
FIG. 1 is a perspective view of a double water-tight structure protecting device for an electric charging part of an electric facility according to a preferred embodiment of the present invention.

100: protective cover
110: first waterproof member
120: second waterproof member
130: bent portion
140: ornamental ring
150: cold cathode illuminants
200: second protective cover
210: third waterproof member
220: fourth waterproof member
300: insulator
310: RFID tag
320: engraved portion
11: first waterproof member joining pin
22: second waterproof member joining pin
33: bolt and nut
44: receiving hole

MODE FOR THE INVENTION

Reference will be now made in detail to the preferred embodiment of the present invention with reference to the attached drawings.

Figure 2:
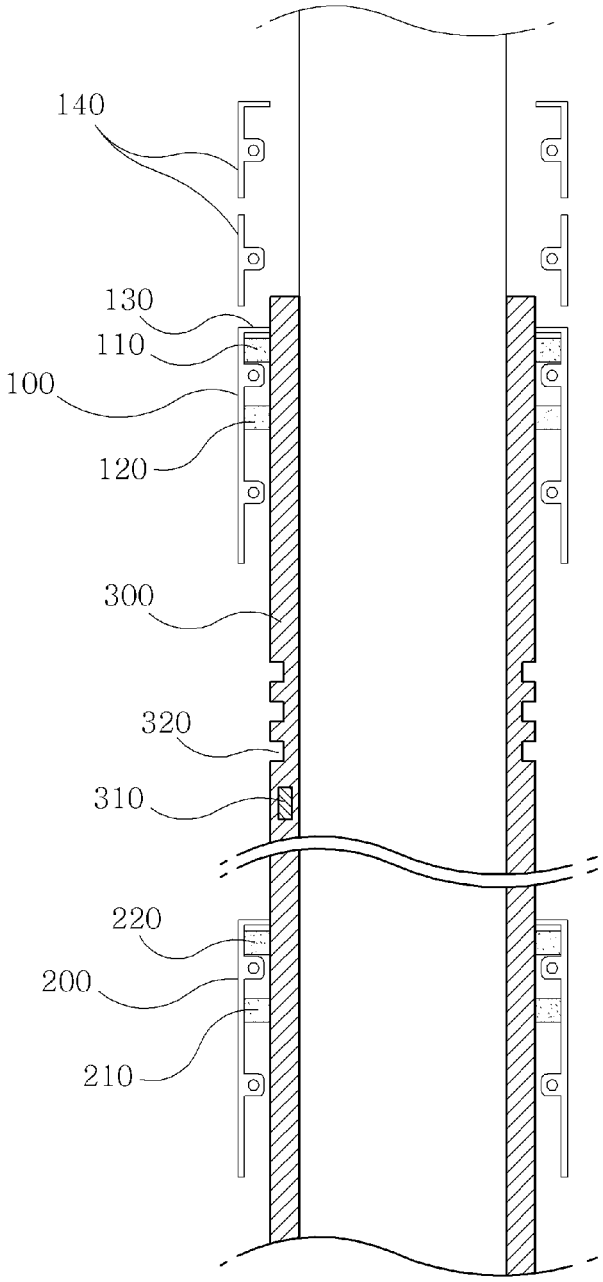
FIG. 2 is a sectional view of the double water-tight structure protecting device according to the preferred embodiment of the present invention.
Figure 3:
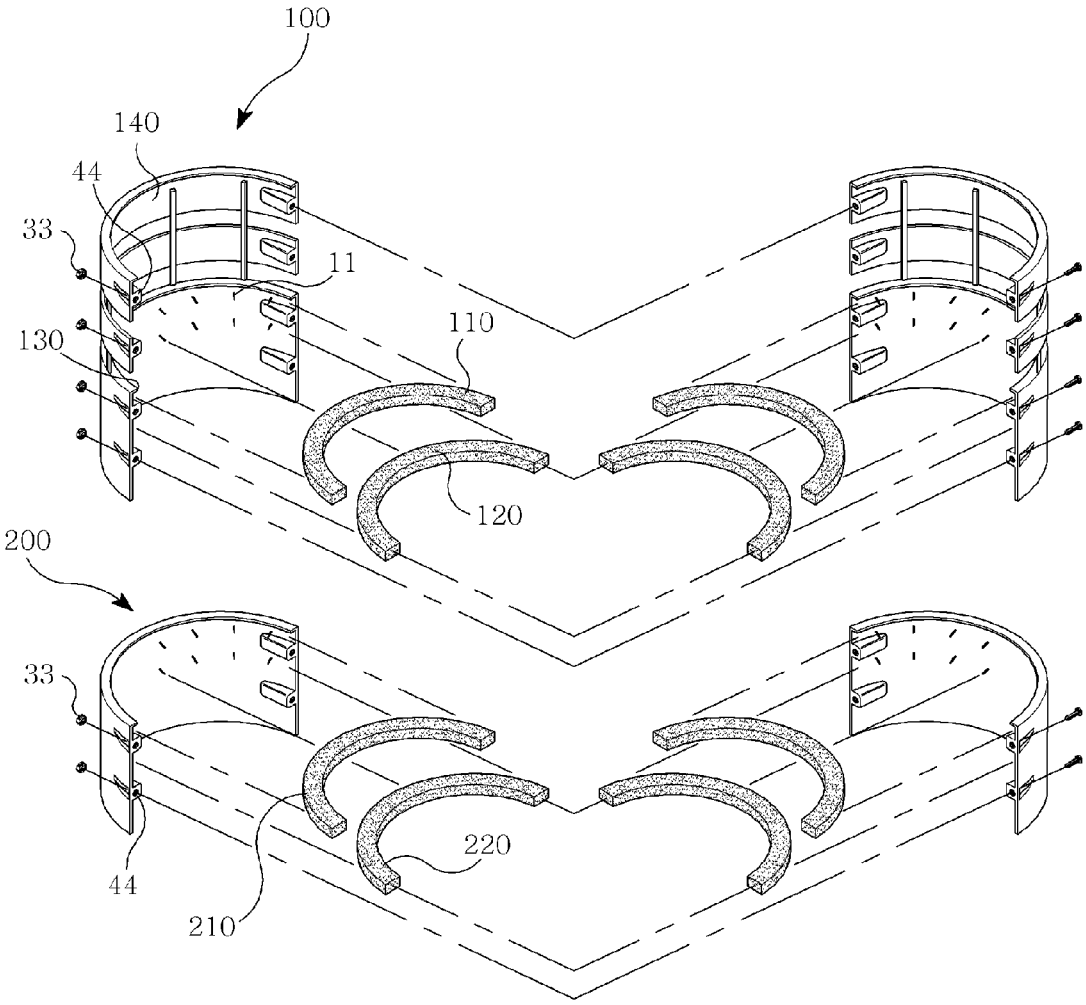
FIG. 3 is a view showing a first protective cover and a first waterproof member and a second waterproof member mounted in the first protective cover; and a view showing a second protective cover and a third waterproof member and a fourth waterproof member mounted in the second protective cover.
Figure 4:
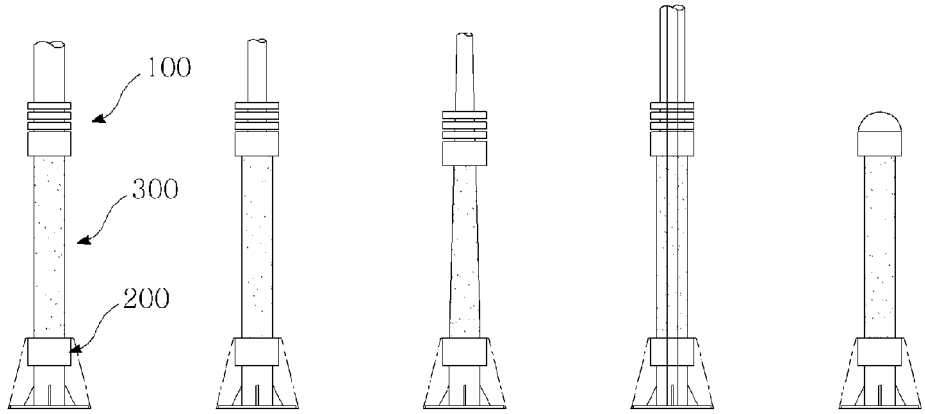
FIG. 4 is a view showing various examples of the outward form of the double water-tight structure protecting device.

FIG. 1 illustrates the entire outward form of a double water-tight structure protecting device for an electric charging part of an electric facility according to a preferred embodiment of the present invention, FIG. 2 is a sectional view of the double water-tight structure protecting device, and FIG. 3 illustrates a first protective cover and a first waterproof member and a second waterproof member mounted in the first protective cover; and a second protective cover and a third waterproof member and a fourth waterproof member mounted in the second protective cover.

As shown in FIGS. 1 and 2, an insulator 300 is attached to the outer peripheral surface of an electric charging part of an electric facility.

The insulator 300 may be made of natural stone powder ingredients or synthetic resin of various kinds, such as rubber-based, soft urethane-based, silicon-based, plastic-based synthetic resin, and so on.

The first protective cover 100 is located on an upper portion of the insulator 300, and is in a tubular form to surround an outer face of the insulator 300.

The first protective cover 100 is not restricted to the round tubular form as shown in the drawings, but may be one of polygonal tubes of various forms according to the outward form of the electric charging part of the electric facility.

The first waterproof member 110 and the second waterproof member 120 are interposed between the insulator 300 and the first protective cover 100, and spaced apart from each other at a predetermined interval as shown in FIG. 3(*a*).

That is, the second waterproof member 120 is located between a lower end portion of the first waterproof member 110 and a lower end portion of the first protective cover 100. In more detail, a sealed space formed between the first waterproof member 110 and the second waterproof member 120 is an area where a sealed-type charging part protecting zone is formed, and an opened space formed between the second waterproof member 120 and the lower end portion of the first protective cover 100 is an area where an open-type charging part protecting zone is formed.

Not shown in the drawings, but if necessary, at least two second waterproof members 120 may be mounted in such a way as to be spaced apart from each other, and in this instance, an open space formed between the second waterproof member 120 mounted at the lowermost portion and the lower end portion of the first protective cover 100 is the area where the open-type charging part protecting zone is formed.

The first waterproof member 110 and the second waterproof member 120 are respectively made of elastic resin, constructed of a strap form as shown in FIG. 3, and fixed on first waterproof member joining pins 11, which project to the height lower than the thickness of the first waterproof member 110 and the second waterproof member 120, in such a way as to direct the center of the first protective cover 100 along the inner peripheral surface of the first protective cover 100.

Furthermore, not shown in the drawings, but the first waterproof member 110 and the second waterproof member 120 may be manufactured in a tube-shaped housing form and interposed between the insulator 300 and the first protective cover 100, or adhered to the inner peripheral surface of the first protective cover 100 with adhesives in such a way as to go a compass along the inner peripheral surface of the first protective cover 100.

The first protective cover 100 includes a bent portion 130 bent toward the center thereof along the upper end rim of the first protective cover 100, and according to circumstances, the bent portion 130 of the first protective cover 100 may be sealed in the form of a cap to thereby completely cover the top of the electric facility.

The second protective cover 200 is located on a lower portion of the insulator 300 (namely, a lower portion of the first protective cover 100), and is constructed of a tubular form to surround the outer face of the insulator 300.

Also, the second protective cover 200 is not restricted to the round tubular form as shown in the drawings, but may be one of polygonal tubes of various forms according to the outward form of the electric charging part of the electric facility.

The third waterproof member 210 and the fourth waterproof member 220 are interposed between the insulator 300 and the second protective cover 200, and spaced apart from each other at a predetermined interval as shown in FIG. 3(*b*).

That is, the fourth waterproof member 220 is located between a lower end portion of the third waterproof member 210 and a lower end portion of the second protective cover 200. In more detail, a sealed space formed between the third waterproof member 210 and the fourth waterproof member 220 is an area where a sealed-type charging part protecting zone is formed, and an opened space formed between the fourth waterproof member 220 and the lower end portion of the second protective cover 200 is an area where an open-type charging part protecting zone is formed. Accordingly, the present invention can increase a shield index of leakage current and enable workers to perform construction work in safety by strengthening watertightness.

Not shown in the drawings, but if necessary, at least two fourth waterproof members 220 may be mounted in such a way as to be spaced apart from each other, and in this instance, an open space formed between the fourth waterproof member 220 mounted at the lowermost portion and the lower end portion of the second protective cover 200 is the area where the open-type charging part protecting zone is formed.

The third waterproof member 210 and the fourth waterproof member 220 are respectively made of elastic resin, constructed of a strap form as shown in FIG. 3(*b*), and fixed on second waterproof member joining pins 22, which project to the height lower than the thickness of the third waterproof member 210 and the fourth waterproof member 220, in such a way as to direct the center of the second protective cover 200 along the inner peripheral surface of the second protective cover 200.

Furthermore, not shown in the drawings, but the third waterproof member 210 and the fourth waterproof member 220 may be manufactured in a tube-shaped housing form and interposed between the insulator 300 and the second protective cover 200 or adhered on the inner peripheral surface of the second protective cover 200 with adhesives in such a way as to go a compass along the inner peripheral surface of the second protective cover 200.

As shown in FIG. 3, the first protective cover 100 and the second protective cover 200 may be constructed of a separable form, which can be divided into pieces along the central axis and assembled together in the tubular form via bolts and nuts 33. In this instance, the pieces of the first protective cover 100 and the second protective cover 200 respectively have receiving holes 44 formed inwardly to receive the bolts and nuts 33. If the first protective cover 100 and the second protective cover 200 are respectively constructed of a single unit form, they can be constructed more simply than the separable protective covers 100 and 200.

As shown in FIGS. 1 and 2, a plurality of ornamental rings 140 may be mounted on the upper portion of the first protective cover 100 in such a way as to be integrated with the first protective cover 100, and in this instance, the plural ornamental rings 140 are spaced apart from each other at a predetermined interval.

Surfaces of the first protective cover 100, the ornamental rings 140 and the second protective cover 200 are coated with environment-resistant resin, such as fluorine resin, and sheet-type cold cathode illuminants 150, such as EL (Electro Luminescence) sheets, are attached to the outer peripheral surfaces of the first protective cover 100 and the ornamental rings 140 to thereby emit light. The first protective cover 100 and the second protective cover 200 are described on the basis of iron processing, but may be manufactured through an extrusion molding of environment-resistant synthetic resin, such as polycarbonate, and images of various colors can be expressed on the surfaces of the protective covers 100 and 200 through a special coating.

On the surface of the insulator 300 located between the first protective cover 100 and the second protective cover 200, formed is an engraved portion 320, on which signs, characters or figures are carved or highly bright reflection paper is attached.

The insulator 300 may further include an RFID tag 310 embedded therein and adapted to save necessary information, such as a location, a direction, a management number, and a repair history of the facility.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

INDUSTRIAL APPLICABILITY

As described above, technical effects of the double water-tight structure protecting device according to the present invention as follows.

First, the present invention can increase a safety index of pedestrians, who walk on the road in the rainfall season when the electric charging part is frequently exposed to the outside.

Second, the present invention forms the charging part protecting zones since the protective covers are mounted on the upper portion and the lower portion of the outer face of the insulator in such a way as to be spaced apart from the insulator.

In other words, the present invention can increase a shield efficiency of the leakage current by forming the sealed-type charging part protecting zone and the open-type charging part protecting zone.

Third, the present invention can prevent adhesion of advertising posters, increase insulation efficiency, and provide an advertising effect since the engraved portion for carving signs, characters or figures thereon or attaching the highly bright reflection paper thereto is formed on the outer peripheral surface of the environmentally-friendly insulator, whereby the present invention can provide an environmentally-friendly image of the facility and an electric shock prevention effect.

Fourth, the present invention does not spoil the beauty of the city and can allow workers to apply a foundation facility necessary for establishing the U-city according to characteristics of the city.

The invention claimed is:

1. A double water-tight structure protecting device for an exposed electric charging part of a vertical road electric tubular facility, the tubular facility receiving therein an electrical wire, the exposed electric charging part resulting from leak current from the electrical wire, the device comprising:

an insulator attached on an outer peripheral surface of the electric charging part;

a first tube-shaped protective cover located at an upper portion of the insulator in such a way as to surround an outer face of the insulator; and first and second waterproof members interposed respectively between the insulator and the first protective cover, the first waterproof member being located at a higher position than the second waterproof member, wherein the first protective cover is spaced from the insulator from a lower end of the second waterproof member to a lower end of the first protective cover.

2. The double water-tight structure protecting device according to claim 1, wherein the first waterproof member and the second waterproof member are respectively made of elastic resin, and constructed of a tube-shaped housing form and interposed between the insulator and the first protective cover.

3. The double water-tight structure protecting device according to claim 2, wherein the insulator comprises an RFID tag embedded therein and adapted to save necessary information, such as a location, a direction, a management number, and a repair history of the facility.

4. The double water-tight structure protecting device according to claim 3, further comprising:

a second protective cover located on a lower portion of the insulator and constructed of a tubular form to surround the outer face of the insulator;

a third waterproof member interposed between the insulator and the second protective cover; and a fourth waterproof member interposed between the insulator and the second protective cover and located between a lower end portion of the third waterproof member and a lower end portion of the second protective cover, wherein the third waterproof member and the fourth waterproof member are respectively made of elastic resin, and constructed of a tube-shaped housing form and interposed between the insulator and the second protective cover.

5. The double water-tight structure protecting device according to claim 4, wherein the first protective cover comprises a bent portion bent toward the center thereof along the upper end rim of the first protective cover or a bent upper end portion of the first protective cover is sealed in the form of a cap.

6. The double water-tight structure protecting device according to claim 5, wherein a plurality of the second waterproof members and the fourth waterproof members are mounted in such a way as to be spaced apart from each other to thereby form a multiple sealing structure.

7. The double water-tight structure protecting device according to claim 6, wherein the first protective cover and the second protective cover are respectively divided into two pieces along the central axis thereof and assembled together in the tubular form via bolts and nuts.

8. The double water-tight structure protecting device according to claim 7, wherein each of the pieces of the first protective cover and the second protective cover comprises a receiving hole formed inwardly to receive the bolts and nuts.

9. The double water-tight structure protecting device according to claim 8, wherein the first protective cover comprises a plurality of ornamental rings mounted on the upper portion thereof in such a way as to be spaced apart from each other and integrated with the first protective cover, wherein, surfaces of the first protective cover, the ornamental rings and the second protective cover are coated with environment-resistant resin, and wherein sheet-type cold cathode illuminants are attached to the outer peripheral surfaces of the first protective cover and the ornamental rings.

10. The double water-tight structure protecting device according to claim 9, wherein on the surface of the insulator located between the first protective cover and the second protective cover, formed is an engraved portion, on which signs, characters or figures are carved or highly bright reflection paper is attached.

11. The double water-tight structure protecting device according to claim 4, wherein the first protective cover and the second protective cover are respectively divided into two pieces along the central axis thereof and assembled together in the tubular form via bolts and nuts.

12. The double water-tight structure protecting device according to claim 11, wherein each of the pieces of the first protective cover and the second protective cover comprises a receiving hole formed inwardly to receive the bolts and nuts.

13. The double water-tight structure protecting device according to claim 12, wherein the first protective cover comprises a plurality of ornamental rings mounted on the upper portion thereof in such a way as to be spaced apart from each other and integrated with the first protective cover, wherein, surfaces of the first protective cover, the ornamental rings and the second protective cover are coated with environment-resistant resin, and wherein sheet-type cold cathode illuminants are attached to the outer peripheral surfaces of the first protective cover and the ornamental rings.

14. The double water-tight structure protecting device according to claim 13, wherein on the surface of the insulator located between the first protective cover and the second protective cover, formed is an engraved portion, on which signs, characters or figures are carved or highly bright reflection paper is attached.

15. The double water-tight structure protecting device according to claim 5, wherein the first protective cover and the second protective cover are respectively divided into two pieces along the central axis thereof and assembled together in the tubular form via bolts and nuts.

16. The double water-tight structure protecting device according to claim 15, wherein each of the pieces of the first protective cover and the second protective cover comprises a receiving hole formed inwardly to receive the bolts and nuts.

17. The double water-tight structure protecting device according to claim 16, wherein the first protective cover comprises a plurality of ornamental rings mounted on the upper portion thereof in such a way as to be spaced apart from each other and integrated with the first protective cover, wherein, surfaces of the first protective cover, the ornamental rings and the second protective cover are coated with environment-resistant resin, and wherein sheet-type cold cathode illuminants are attached to the outer peripheral surfaces of the first protective cover and the ornamental rings.

18. The double water-tight structure protecting device according to claim 17, wherein on the surface of the insulator located between the first protective cover and the second protective cover, formed is an engraved portion, on which signs, characters or figures are carved or highly bright reflection paper is attached.

* * * * *